US012796737B2

(12) United States Patent
Wang

(10) Patent No.: US 12,796,737 B2
(45) Date of Patent: Nov. 17, 2026

(54) ELECTRONIC CIGARETTE

(71) Applicant: YIBLA (USA) TECHNOLOGY CO., LTD, City of Industry, CA (US)

(72) Inventor: Guangrui Wang, Puyang (CN)

(73) Assignee: YIBLA (USA) TECHNOLOGY CO., LTD, City of Industry, CA (US)

( * ) Notice: Subject to any disclaimer, the term of this patent is extended or adjusted under 35 U.S.C. 154(b) by 495 days.

(21) Appl. No.: 18/498,155

(22) Filed: Oct. 31, 2023

(65) Prior Publication Data

US 2025/0134167 A1 May 1, 2025

(51) Int. Cl.

| | |
|---|---|
| ***A24F 40/46*** | (2020.01) |
| ***A24F 40/10*** | (2020.01) |
| ***A24F 40/48*** | (2020.01) |
| ***A24F 40/51*** | (2020.01) |

(52) U.S. Cl.

CPC ..... *A24F 40/46* (2020.01); *A24F 40/10* (2020.01); *A24F 40/48* (2020.01); *A24F 40/51* (2020.01)

(58) Field of Classification Search

None

See application file for complete search history.

(56) References Cited

U.S. PATENT DOCUMENTS

2018/0020738 A1* 1/2018 Qiu ..... A24F 40/485 131/329
2018/0070638 A1* 3/2018 Qiu ..... H02J 7/32

FOREIGN PATENT DOCUMENTS

CN 218073490 U * 12/2022

OTHER PUBLICATIONS

CN218073490U English Translated obtained through Espacenet (Year: 2022).*

* cited by examiner

*Primary Examiner* — Christopher M Rodd
*Assistant Examiner* — Hannah Chinwe Nnabugwu
(74) *Attorney, Agent, or Firm* — Getech Law LLC; Jun Ye

(57) ABSTRACT

The present invention relates to an electronic cigarette, which includes a shell, a suction nozzle, a liquid storage tube, an elastic sealing seat, an atomizing core and an airflow sensor, wherein the shell is provided with an accommodating cavity; the suction nozzle is connected with the shell, and the liquid storage tube is located in the accommodating cavity; a first end of the elastic sealing seat covers a tube mouth of the liquid storage tube facing the suction nozzle, and is provided with a smoke exhaust hole connected with the suction nozzle, and a second end of the elastic sealing seat is provided with a mounting slot; the atomizing core is located in the liquid storage tube and communicated with the smoke exhaust hole; and the airflow sensor is located in the mounting slot. The electronic cigarette provided by the present invention has high sensitivity, greater smoke concentration.

20 Claims, 8 Drawing Sheets

ELECTRONIC CIGARETTE

TECHNICAL FIELD

The present invention relates to the technical field of an electronic cigarette and, more specifically, to an electronic cigarette

BACKGROUND

Because electronic cigarettes do not have tar, suspended particles and other harmful components, they have a wide range of application markets. The existing electronic cigarette usually comprises a shell, a liquid storage bin, atomizing core, a battery, an airflow sensor and a controller, a top of the shell is connected with a suction nozzle, a bottom of the shell is provided with an intake hole, the liquid storage bin is located in the shell, the liquid storage bin is used to store cigarette liquid, the atomizing core is located in the liquid storage bin and connected with the suction nozzle. The airflow sensor is located at the bottom of the shell and is used to detect whether a user is smoking.

When the user smokes, the airflow sensor senses that the user smokes and triggers the controller, the controller controls the battery to supply power to the atomizing core, and the atomizing core atomizes the cigarette liquid to form smoke for the user to smoke. However, due to the airflow sensor is far away from the suction nozzle, when smoking, the airflow sensor is triggered only after air in the suction nozzle and liquid storage bin is sucked, so the sensitivity is low and the taste is poor.

SUMMARY

The present invention aims to provide an electronic cigarette which can improve the sensitivity and the taste.

A solution of the present invention to solve the above problem is as follows: an electronic cigarette is constructed, wherein the electronic cigarette comprises a shell, a suction nozzle, a liquid storage tube, an elastic sealing seat, an atomizing core and an airflow sensor, wherein the shell is provided with an accommodating cavity; the suction nozzle is connected with the shell, and the liquid storage tube is located in the accommodating cavity; a first end of the elastic sealing seat covers a tube mouth of the liquid storage tube facing the suction nozzle, and is provided with a smoke exhaust hole connected with the suction nozzle, and a second end of the elastic sealing seat is provided with a mounting slot, and the mounting slot is arranged in parallel with the smoke exhaust hole in a spaced manner; the atomizing core is located in the liquid storage tube and communicated with the smoke exhaust hole; and the airflow sensor is located in the mounting slot.

The present invention has the following beneficial effects: as the first end of the elastic sealing seat covers the tube mouth of the liquid storage tube facing the suction nozzle, and is provided with the smoke exhaust hole connected with the suction nozzle, and the second end of the elastic sealing seat is provided with the mounting slot; the atomizing core is located in the liquid storage tube and communicated with the smoke exhaust hole; and the airflow sensor is located in the mounting slot. Therefore, the airflow sensor is close to a sucking part, which can improve the sensitivity of smoking and obtain greater smoke concentration and better taste. In addition, because the mounting slot is arranged in parallel with the smoke exhaust hole in a spaced manner, the problem of short service life is avoided when the airflow sensor is located at the bottom of the shell in relative technology, which is easy to be polluted by the leaked cigarette liquid.

BRIEF DESCRIPTION OF DRAWINGS

The present invention is described below in combination with the attached drawings, wherein.

DETAILED DESCRIPTION

The present invention is described in detail in combination with the attached drawings and specific implementations.

Figure 1:
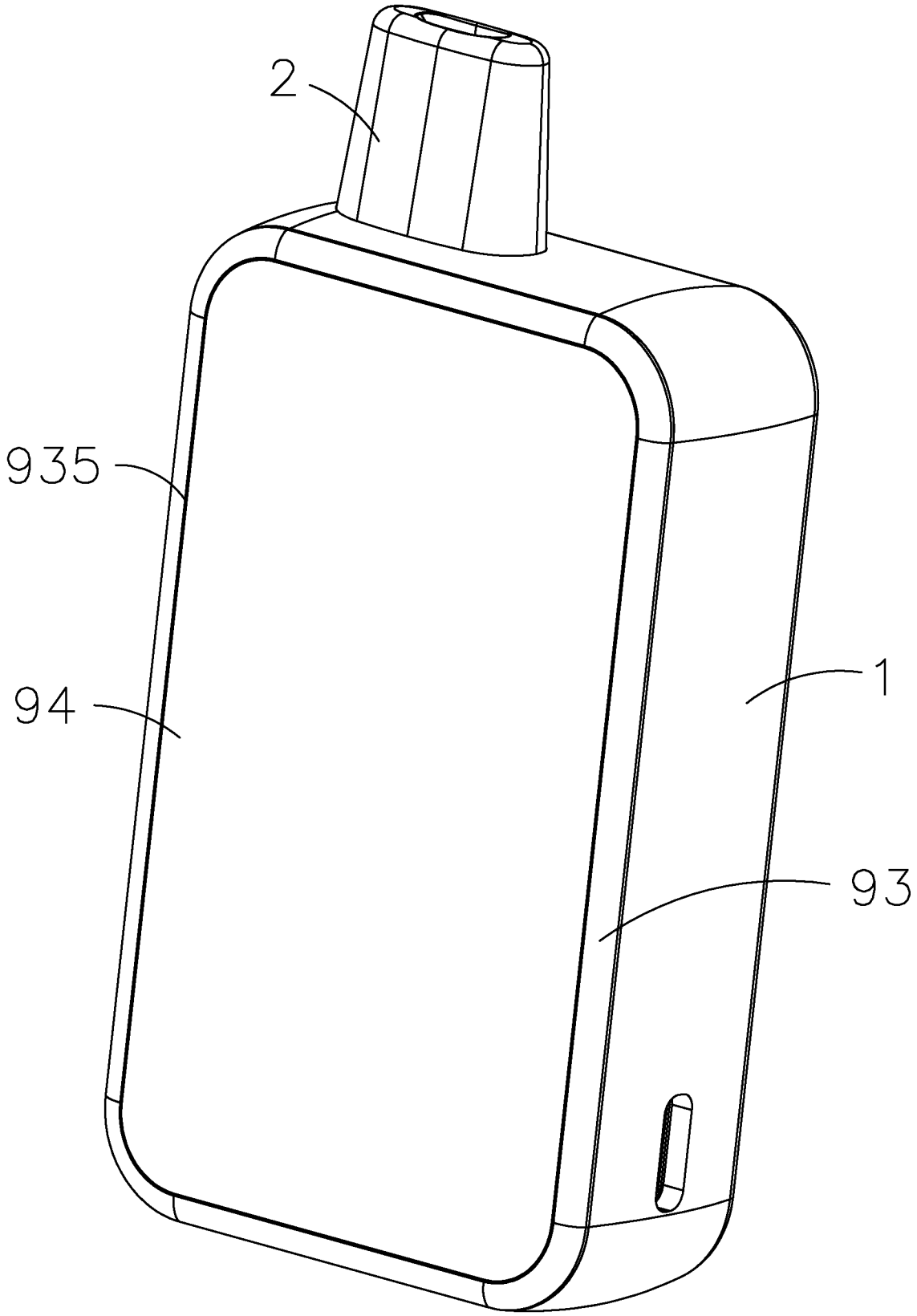
FIG. 1 is a three-dimensional diagram of an electronic cigarette in an embodiment of the present invention.
Figure 2:
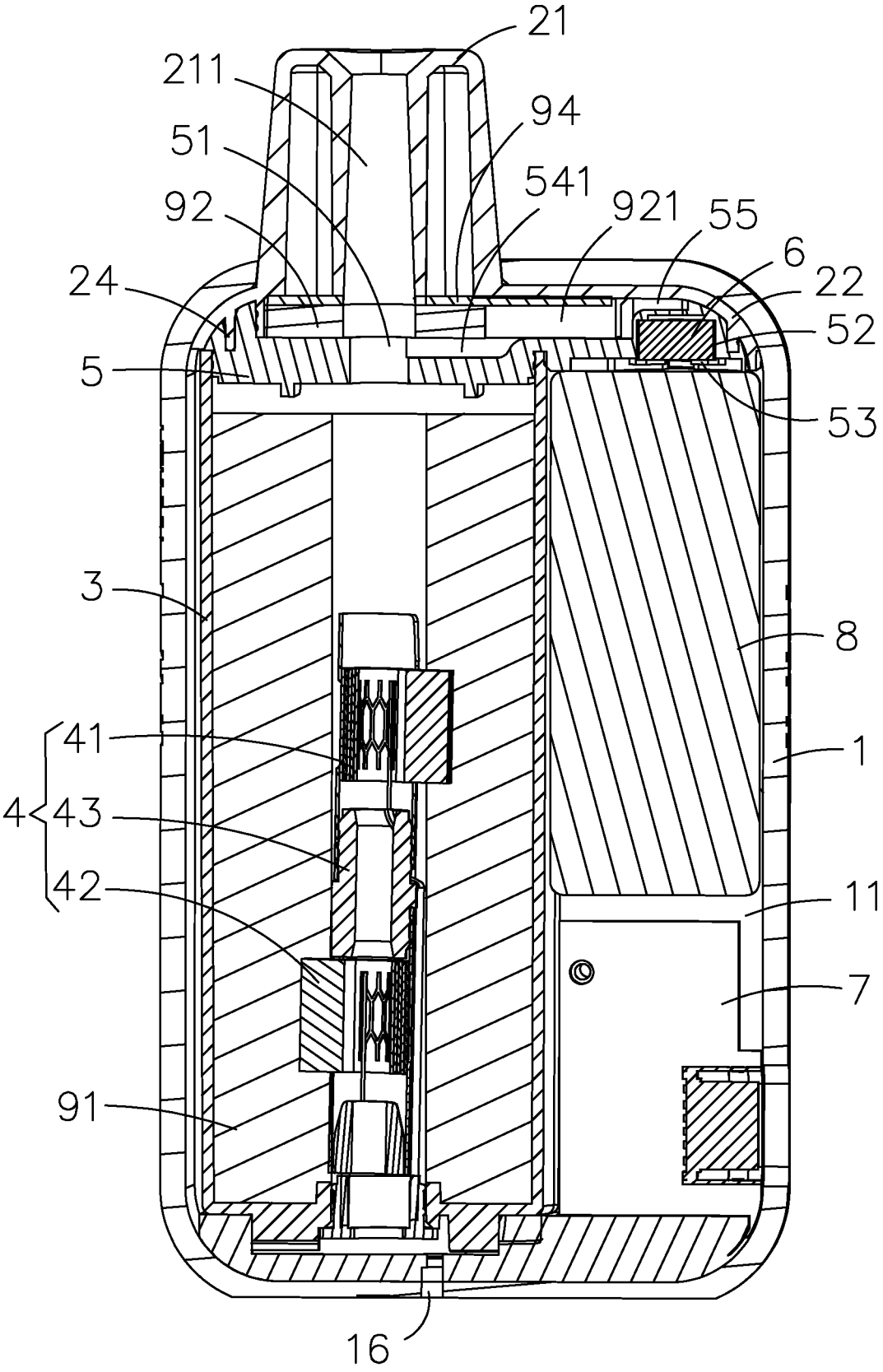
FIG. 2 is a section view of the electronic cigarette shown in FIG. 1.
Figure 3:
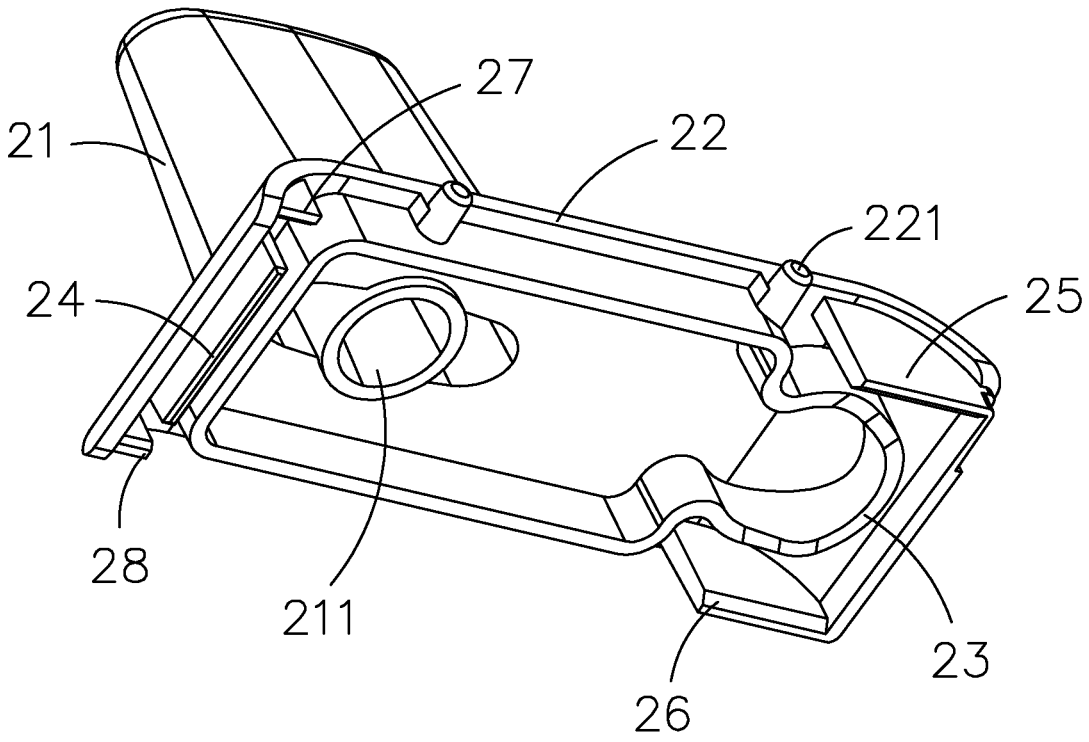
FIG. 3 is a three-dimensional diagram of a suction nozzle of the electronic cigarette shown in FIG. 1.
Figure 4:
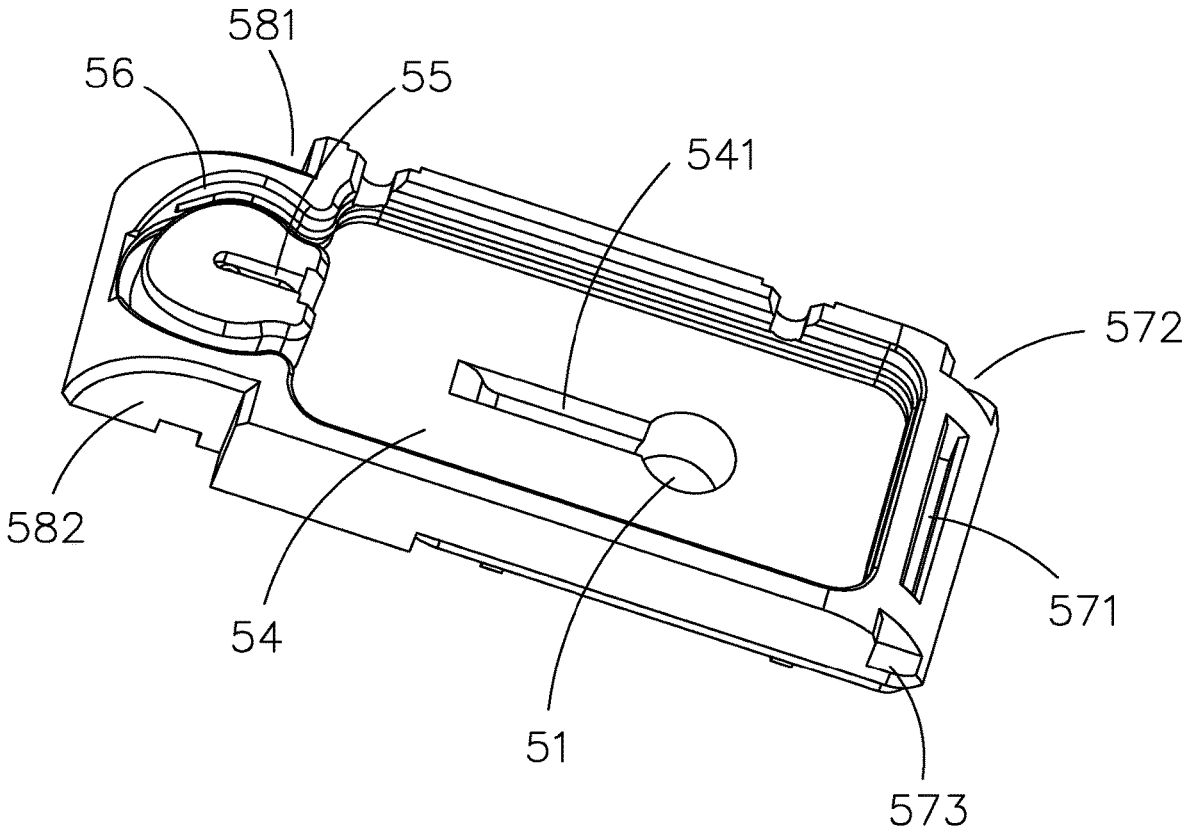
FIG. 4 is a three-dimensional diagram of an elastic sealing seat of the electronic cigarette shown in FIG. 1 from a perspective.
Figure 5:
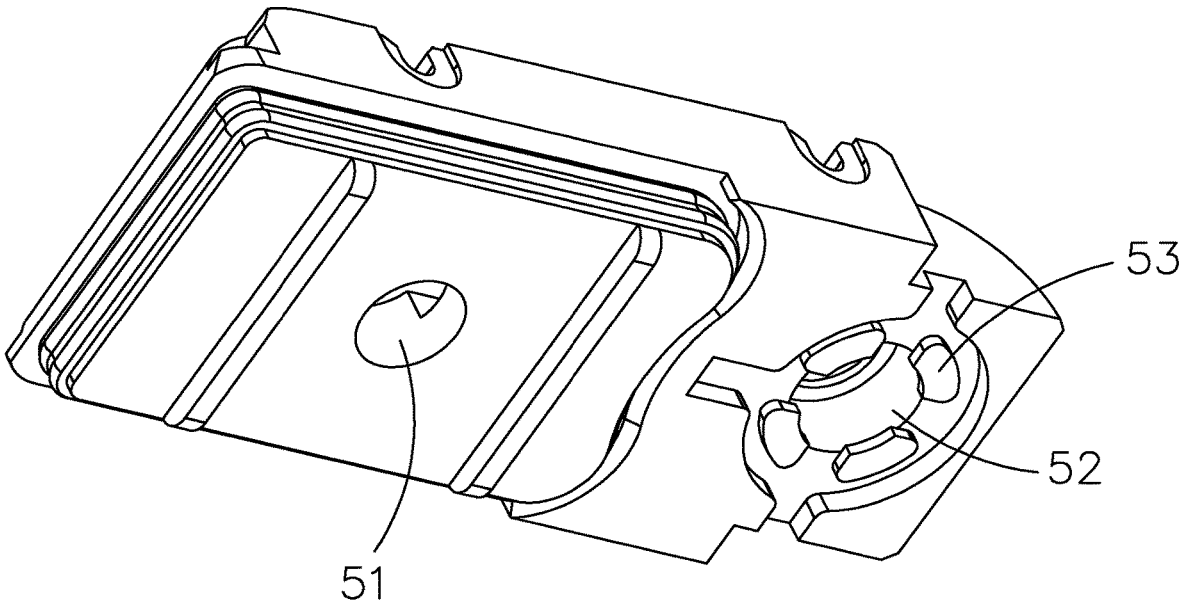
FIG. 5 is a three-dimensional diagram of an elastic sealing seat of the electronic cigarette shown in FIG. 1 from another perspective.
Figure 6:
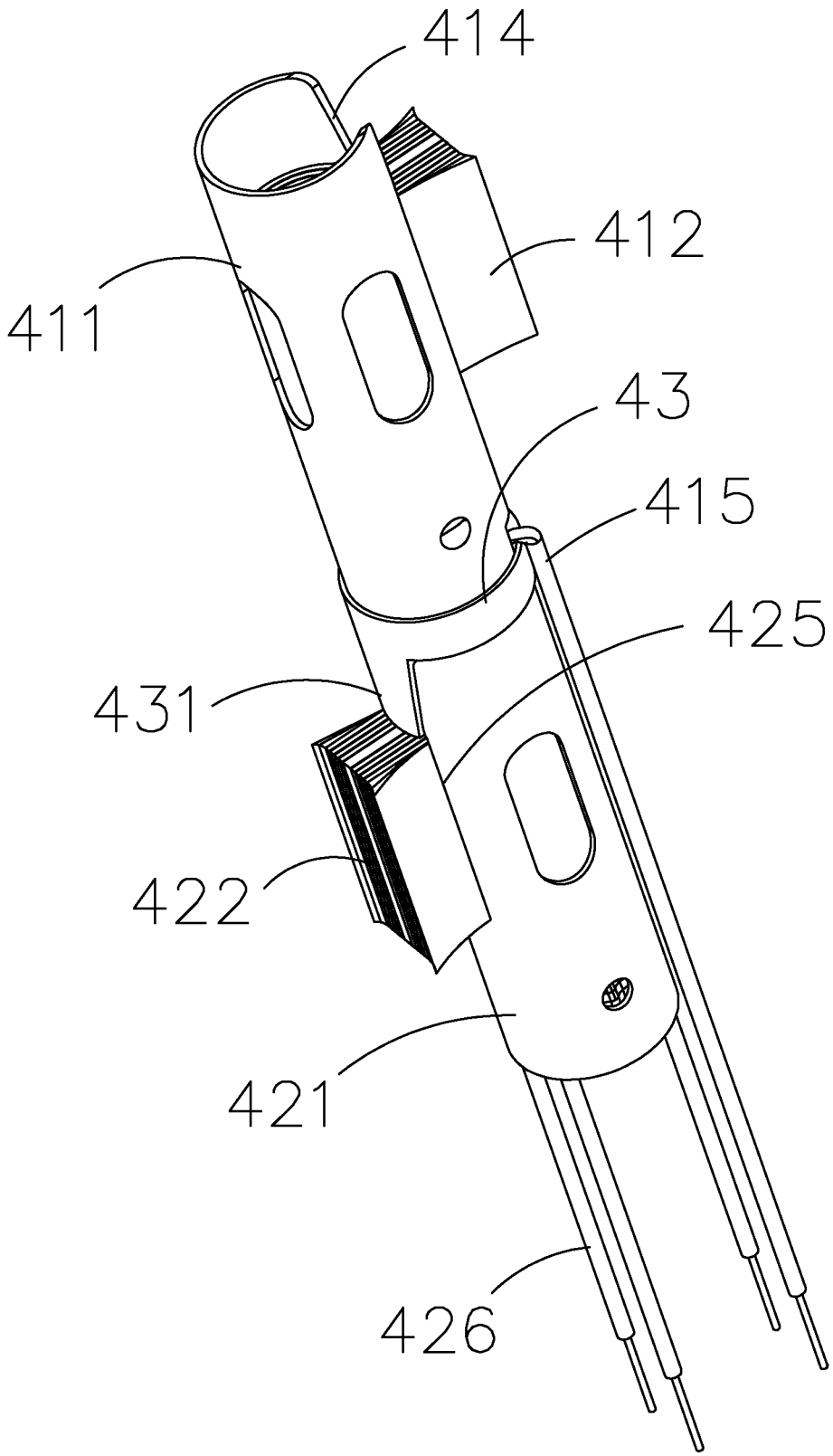
FIG. 6 is a three-dimensional diagram of an atomizing core of the electronic cigarette shown in FIG. 1.
Figure 7:
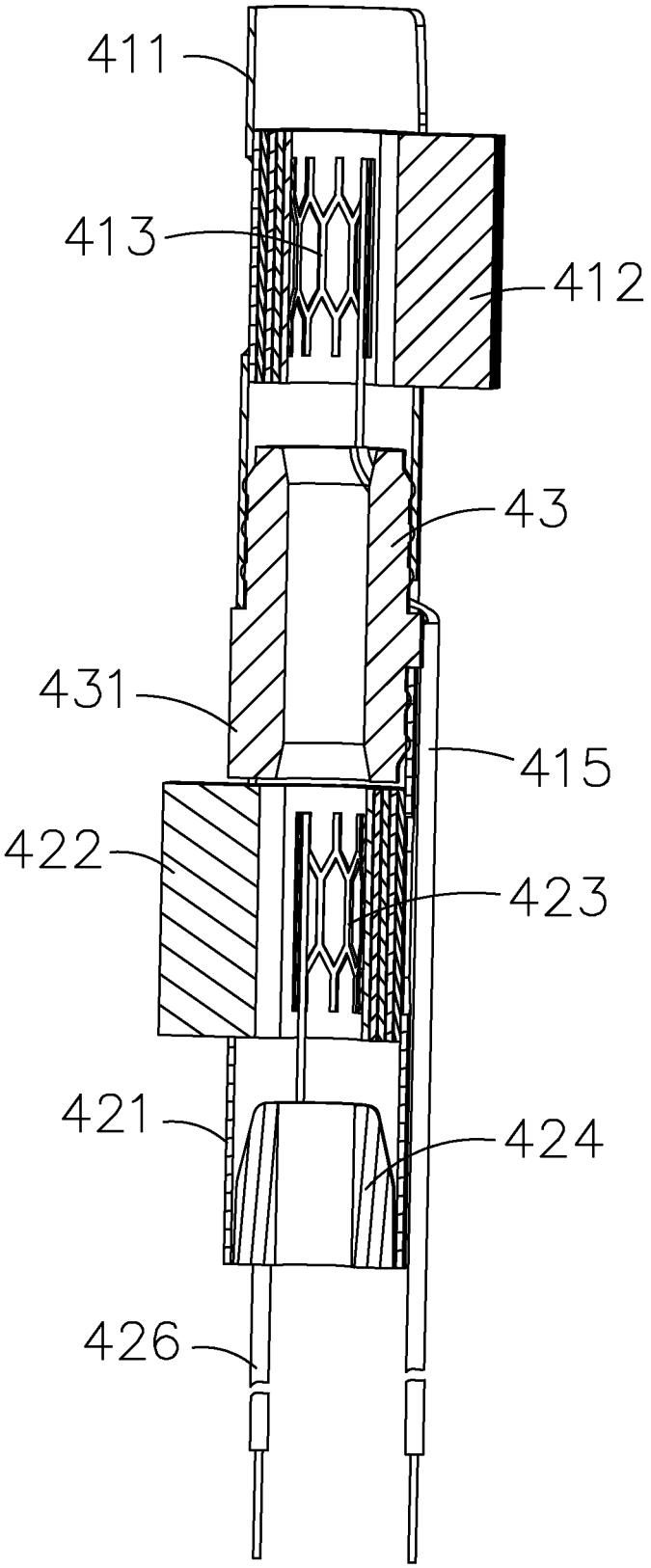
FIG. 7 is a section view of the atomizing core of the electronic cigarette shown in FIG. 6.
Figure 8:
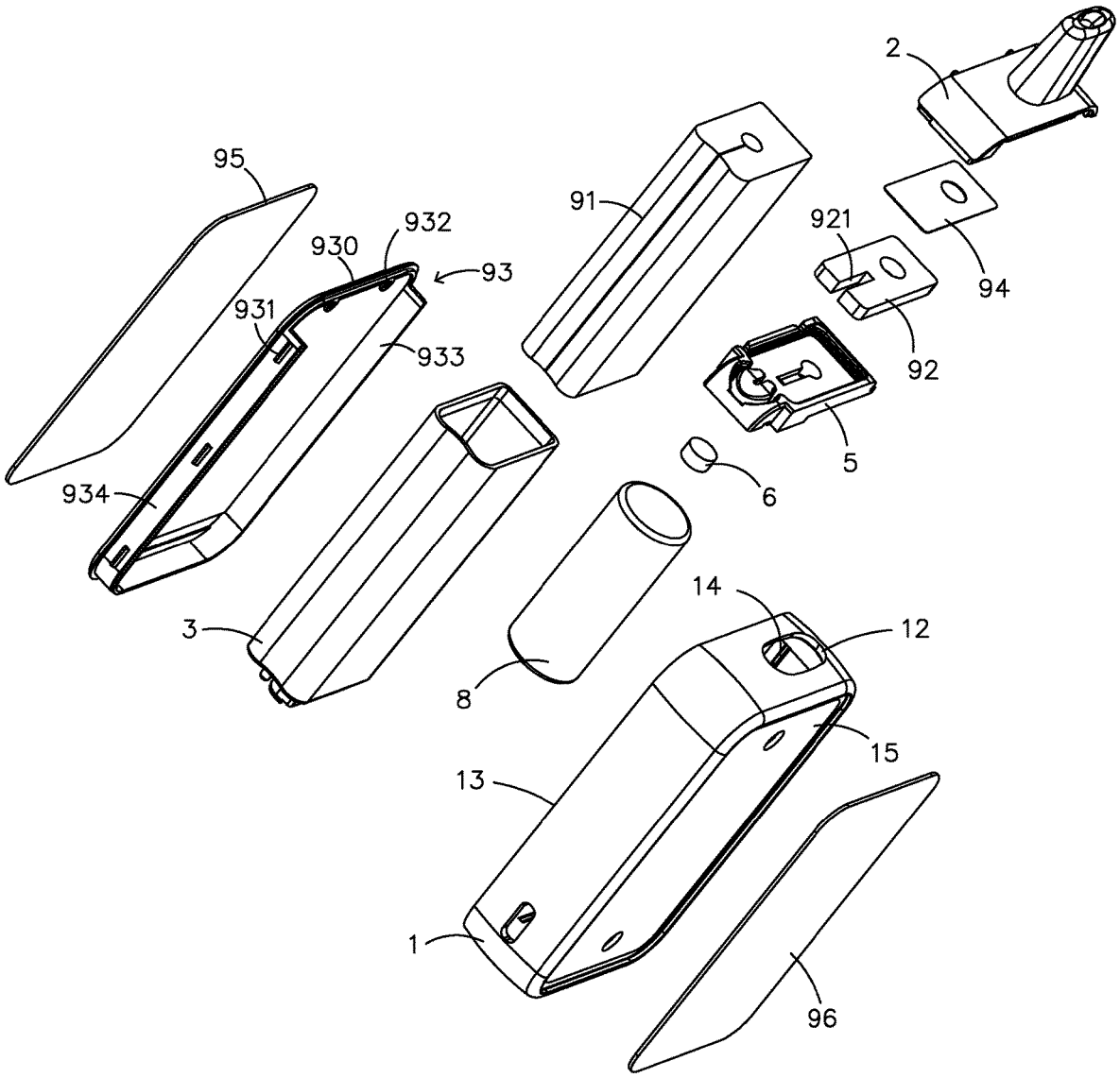
FIG. 8 is an exploded view of a part structure of the electronic cigarette shown in FIG. 1.

Refer to FIG. 1 to FIG. 8, the present invention provides an electronic cigarette, wherein the electronic cigarette comprises a shell 1, a suction nozzle 2, a liquid storage tube 3, an atomizing core 4, an elastic sealing seat 5, an airflow sensor 6 and a controller 7. The shell 1 is provided with an accommodating cavity 11 and a connecting hole 12 communicated with the accommodating cavity 11, and a battery 8 is contained in the accommodating cavity 11. The connecting hole 12 is located at a top wall of the shell 1. A mounting mouth 13 is arranged on a side wall of the shell 1, and the mounting mouth 13 is communicated with the accommodating cavity 11. Assembly is facilitated by fitting parts from the mounting mouth 13 to the accommodating cavity 11 during production.

A fastening groove 14 is arranged at a cavity wall of the accommodating cavity 11. The fastening groove 14 is arranged in a strip shape and extends along a length direction of the accommodating cavity 11. A second fixed slot 15 is arranged on a side wall of the shell 1 opposite to the position of the mounting mouth 13, and the second fixed slot 15 is arranged opposite to the accommodating cavity 11. A bottom wall of the shell 1 is provided with an intake hole 16. The intake hole 16 is communicated with the atomizing core 4.

The suction nozzle 2 is connected with the shell 1. The suction nozzle 2 comprises a sucking part 21 and a covering part 22. A first end of the sucking part 21 is located outside the shell 1, and a second end of the sucking part 21 is extended into the accommodating cavity 11 through the connecting hole 12. A smoke outlet hole 211 is provided in the sucking part 21, and smoke formed by atomization of the atomizing core 4 is discharged from the smoke outlet hole 211. The covering part 22 is located in the accommodating cavity 11 and is connected to the second end of the sucking part 21, and an upper surface of the covering part 22 is abutted against the shell 1. A first positioning part 221 is arranged on a side of the covering part 22.

The covering part 22 extends towards the elastic sealing seat 5 to form a sealing wall part 23, a positioning wall part 24, a first clamping wall part 25, a second clamping wall part 26, a third clamping wall part 27 and a fourth clamping wall part 28. The first clamping wall part 25 and the second clamping wall part 26 are arranged at one end of the covering part 22 in a spaced manner. The positioning wall part 24, the third clamping wall part 27 and the fourth clamping wall part 28 are located at the other end of the covering part 22, and the positioning wall part 24 is located between the third clamping wall part 27 and the fourth clamping wall part 28. The sealing wall part 23 is in an annular shape, and a smoke inlet of the smoke outlet hole 211 is located in space formed by the sealing wall part 23. Therefore, air leakage is better avoided and the sensitivity of smoking is improved.

The liquid storage tube 3 is located in the accommodating cavity 11 and is arranged in parallel with the battery 8. A porous liquid suction column 91 is inserted into the liquid storage tube 3, the porous liquid suction column 91 is sleeved on the atomizing core 4, and the porous liquid suction column 91 is used for absorbing cigarette liquid. The atomizing core 4 is located in the liquid storage tube 3 and is used for atomizing the cigarette liquid in the porous liquid suction column 91. The porous liquid suction column 91 can be made of fiber or foam material, etc.

The atomizing core 4 comprises a first heating component 41, a second heating component 42 and a connecting part 43. The first heating component 41 and the second heating component 42 are used for atomizing the cigarette liquid. The first heating component 41 comprises a first metal tube 411, a first porous liquid guide sheet 412 and a first heating element 413. A first end of the first metal tube 411 is provided with a first liquid inlet notch 414, and the first porous liquid guide sheet 412 is mounted in the first metal tube 411 and extends from the first liquid inlet notch 414 to contact the porous liquid suction column 91. Preferably, a width of an end face of the first porous liquid guide sheet 412 that extends outside the first metal tube 411 is greater than a width of the first liquid inlet notch 414, thus improving the liquid supply efficiency. The first heating element 413 is located in the first metal tube 411 and is in contact with the first porous liquid guide sheet 412 for atomizing the cigarette liquid of the first porous liquid guide sheet 412. The first heating element 413 is connected with a first wire 415 to be electrically connected to the controller 7 through the first wire 415.

The second heating component 42 comprises a second metal tube 421, a second porous liquid guide sheet 422, a second heating element 423 and a clamping seat 424. The second metal tube 421 is interconnected with the first metal tube 411. A first end of the second metal tube 421 is provided with a second liquid inlet notch 425, the first liquid inlet notch 414 and the second liquid inlet notch 425 face opposite directions, thus avoiding insufficient supply of the cigarette liquid and dry burning. The second porous liquid guide sheet 422 is mounted in the second metal tube 421 and extends from the second liquid inlet notch 425 to contact the porous liquid suction column 91. A width of an end face of the second porous liquid guide sheet 422 that extends outside the second metal tube 421 is greater than a width of the second liquid inlet notch 425, thus improving the liquid supply efficiency. The first porous liquid guide sheet 412 and the second porous liquid guide sheet 422 can be made of man-made fiber, natural fiber or other materials.

The second heating element 423 is located in the second metal tube 421 and is in contact with the second porous liquid guide sheet 422 for atomizing the cigarette liquid of the second porous liquid guide sheet 422. The second heating element 423 is connected with a second wire 426 to be electrically connected to the controller 7 through the second wire 426. The clamping seat 424 is inserted in the second metal tube 421, and the clamping seat 424 and the second metal tube 421 jointly clamp the second wire 426 to prevent the second wire 426 from being pulled off by an external force. The first heating element 413 and the second heating element 423 can be electric heating networks, or electric heating wires, etc.

A first end of the connecting part 43 is detachably connected to the first heating component 41, a second end of the connecting part 43 is detachably connected to the second heating component 42, and the second heating component 42 is communicated to the first heating component 41 through the connecting part 43. During assembly, the first end of the connecting part 43 is first assembled with the first heating component 41 in an inserting manner, and then the second end of the connecting part 43 is connected with the second heating component in an inserting manner, so that the assembly is easy, the respective wires are easy to be arranged which avoids the interaction between the first heating component and the second heating component, and the production efficiency is high.

In this embodiment, the connecting part 43 is an elastic connection tube made of silica gel, a first end of the elastic connection tube is inserted into the first heating component 41, and a second end of the elastic connection tube is inserted into the second heating component 42. Specifically, the first end of the elastic connection tube is inserted in the first metal tube 411, and the second end of the elastic connection tube is inserted in the second metal tube 421. The elastic connection tube is provided with an extension part 431 extending to the first metal tube 411 and the second metal tube 421, and the extension part 431 extends into the second liquid inlet notch 425, so that orientations of the first liquid inlet notch 414 and the second liquid inlet notch 425 can be guaranteed during the assembly, which improves the product yield.

A cross-sectional area of the elastic connection tube at the extension part 431 is greater than a cross-sectional area of the first metal tube 411 and a cross-sectional area of the second metal tube 421. Thus, the outside of the first metal tube 411 and the second metal tube 421 can form an annular-shaped liquid supply channel, and the cigarette liquid in the annular-shaped liquid supply channel can be quickly adsorbed by an end face of the first porous liquid guide sheet 412 and an end face of the second porous liquid guide sheet 422. Therefore, the liquid guide effect is good, the amount of the smoke is stable, which avoids the problem in the prior art that the dry burning is caused as external liquid supply is not smooth.

The elastic sealing seat 5 is located in the accommodating cavity 11, and a first end of the elastic sealing seat 5 covers a tube mouth of the liquid storage tube 3 facing the suction nozzle 2 so as to seal the tube mouth of the liquid storage tube 3. The liquid storage tube 3 and the covering part 22 jointly clamp the elastic sealing seat 5, so that the air leakage is better avoided and the sensitivity of smoking is improved. A smoke exhaust hole 51 communicated with the suction nozzle 2 is arranged at a position corresponding to the elastic sealing seat 5 and the tube mouth of the liquid storage tube 3, and the atomizing core 4 is communicated with the smoke exhaust hole 51. The smoke exhaust hole 51 is used to discharge the smoke, which is formed by atomizing the cigarette liquid through the atomizing core 4, to the suction nozzle 2.

A second end of the elastic sealing seat 5 is provided with a mounting slot 52. The mounting slot 52 is located at a lower surface of the second end of the elastic sealing seat 5. The mounting slot 52 is arranged in parallel with the smoke exhaust hole 51 in a spaced manner and above the battery 8. A rabbet of the mounting slot 52 is provided with a blocking protruding part 53. The airflow sensor 6 is located in the mounting slot 52 and communicated with the sucking part 21, and the blocking protruding part 53 is located on a side of the airflow sensor 6 opposite to the covering part 22 to prevent the airflow sensor 6 from falling. The covering part 22 covers a surface of the elastic sealing seat 5 opposite to the liquid storage tube 3, a sensing airway is formed between the covering part 22 and the elastic sealing seat 5, and the airflow sensor 6 is connected with the sucking part 21 through the sensing airway.

In addition, a surface of the elastic sealing seat 5 facing the sucking part 21 is also provided with an accommodating slot 54, a second gas slot 55 and a sealing slot 56, and a bottom wall of the accommodating slot 54 is provided with a first gas slot 541, and the first gas slot 541 is communicated with the smoke exhaust hole 51. The second gas slot 55 is located on an upper surface of the second end of the elastic sealing seat 5 and is located above the mounting slot 52 and communicated with the mounting slot 52 and the accommodating slot 54. The accommodating slot 54 and the second gas slot 55 form the sensing airway, and the airflow sensor 6 is communicated with the sucking part 21 through the accommodating slot 54 and the second gas slot 55. A lower surface of the covering part 22 is abutted against the elastic sealing seat 5 and seals an upper surface of the elastic sealing seat 5, thus improving the sealing property of the sensing airway. The sealing slot 56 is arranged around the sensing airway, and the sealing wall part 23 is inserted in the sealing slot 56, so the sealing property is better, the air leakage is better avoided, which further improves the sensitivity of smoking.

The first end of the elastic sealing seat 5 is also provided with a positioning slot 571, and the positioning wall part 24 is inserted in the positioning slot 571, thus avoiding the air leakage caused by deflecting the suction nozzle 2. A first side of the first end of the elastic sealing seat 5 is provided with a first clamping slot 572, a second side of the first end of the elastic sealing seat 5 is provided with a second clamping slot 573, and the first side of the first end of the elastic sealing seat 5 and the second side of the first end of the elastic sealing seat 5 are set opposite to each other. The positioning slot 571 is located between the first clamping slot 572 and the second clamping slot 573. The third clamping wall part 27 is inserted in the first clamping slot 572, and the fourth clamping wall part 28 is inserted in the second clamping slot 573. Therefore, it is ensured that the first end of the elastic sealing seat 5 is not easy to be squeezed and deformed, which improves the sealing performance.

The second end of the elastic sealing seat 5 is also provided with a first clamping notch 581 and a second clamping notch 582, and the sealing slot 56 is located between the first clamping notch 581 and the second clamping notch 582. The first clamping wall part 25 is inserted in the first clamping gap 581, and the second clamping wall part 26 is inserted in the second clamping gap 582. Therefore, it is ensured that the second end of the elastic sealing seat 5 is not easy to be squeezed and deformed, which improves the sealing performance. It is understood that the elastic sealing seat 5 can be made of an elastic material such as silicone.

The electronic cigarette also comprises a condensate adsorption sheet 92 and a cover plate 93. The condensate adsorption sheet 92 is located in the accommodating slot 54, which is used to absorb condensate flowing from the sucking part 21 to avoid the leakage of the condensate. The condensate adsorption sheet 92 is provided with a ventilation notch 921, and the ventilation notch 921 is communicated with the second gas slot 55 and the first gas slot 541. A first end of the ventilation notch 921 is communicated with the first gas slot 541, and a second end of the ventilation notch 921 is communicated with the mounting slot 52 through the second gas slot 55, that is, the mounting slot 52 is communicated with the ventilation notch 921 through the second gas slot 55, and the height of the second gas slot 55 is higher than the height of the first gas slot 541. Therefore, even if the condensate adsorption sheet 92 is supersaturated, the condensed cigarette liquid can be discharged from the first gas slot 541 without flowing into the airflow sensor 6. An upper cover of the condensate adsorption sheet 92 is provided with a sealing sheet 94 to enhance the sealing property.

The cover plate 93 covers the mounting mouth 13 and is connected with the covering part 22, so the connection is more stable and reliable. The cover plate 93 is provided with a fastening bulge 931, and the fastening bulge 931 is connected with the fastening groove 14 in a fastening manner, so it is not only easy to assemble, but also ensures the stable and reliable connection between the cover plate 93 and the shell 1. Preferably, the cover plate 93 is provided with a second positioning part 932, and the first positioning part 221 is connected with the second positioning part 932, so that the assembly of the cover plate 93 can be better ensured during the assembly. In this embodiment, the first positioning part 221 is a positioning column, and the second positioning part 932 is a positioning hole.

The cover plate 93 comprises a plate body 930, the plate body 930 covers the mounting mouth 13, a first side edge of the plate body 930 extends into the accommodating cavity 11 to form a first connection bar 933, and a second side edge of the plate body 930 extends into the accommodating cavity 11 to form a second connection bar 934, the first connection bar 933 and the second connection bar 934 are disposed opposite to each other, and the first connection bar 933 and the second connection bar 934 are both provided with the fastening bulge 931. Thus, the connection is more stable and reliable.

The electronic cigarette also comprises a first protection sheet 95 and a second protection sheet 96. A first fixed slot 935 is arranged on a side of the plate body 930 opposite to the accommodating cavity 11, and the first protection sheet 95 is accommodated in the first fixed slot 935 and connected with the first fixed slot 935. The second protection sheet 96 is accommodated in the second fixed slot 15 and connected with the second fixed slot 15. The service life of the present invention can be improved by the cooperation of the first protection sheet 95 and the second protection sheet 96. The controller 7 is electrically connected with the airflow sensor 6 and the battery 8. When a user smokes, the airflow sensor 6 triggers the controller 7, then the controller 7 controls the battery 8 to supply power to the atomizing core 4 to atomize the cigarette liquid.

In summary, the first end of the elastic sealing seat 5 of the present invention covers the tube mouth of the liquid storage tube 3 facing the suction nozzle 2, and is provided with the smoke exhaust hole 51 communicated with the suction nozzle 2, and the second end of the elastic sealing seat 5 is provided with the mounting slot 52. The atomizing core 4 is located in the liquid storage tube 3, and is communicated with the smoke exhaust hole 51. The airflow sensor 6 is located in the mounting slot 52. Therefore, the airflow sensor 6 is close to a sucking part, which can improve the sensitivity of smoking and obtain greater smoke concentration and better taste. In addition, because the mounting slot 52 is arranged in parallel with the smoke exhaust hole 51 in a spaced manner, the problem of short service life is avoided when the airflow sensor 6 is located at the bottom of the shell 1 in relative technology, which is easy to be polluted by the leaked cigarette liquid.

It is obvious to a person skilled in the art that the present invention is not limited to the details of the exemplary embodiments described above and can be realized in other concrete forms without deviating from the spirit or essential features of the present invention. Therefore, the embodiments should be regarded in all respects as exemplary and non-restrictive, and the scope of the present invention is defined by the attached claims and not by the above description. It is therefore intended to encompass in the present invention all variations that fall within the meaning and scope of the equivalents of the claims. Any reference number in the claims shall not be deemed to limit the claim to which it relates.

In addition, it should be understood that, although this specification is described in terms of the implementations, not each implementation contains only an independent technical solution, and that the specification is described in this manner only for the sake of clarity, the specification should be taken as a whole by a person skilled in the art, and the technical solutions in various embodiments may be appropriately combined to form other implementations that are understandable to a person skilled in the art.

What is claimed is:

1. An electronic cigarette, comprising a shell, a suction nozzle, a liquid storage tube, an elastic sealing seat, an atomizing core and an airflow sensor, wherein:

the shell is provided with an accommodating cavity; the suction nozzle is connected with the shell, and the liquid storage tube is located in the accommodating cavity; a first end of the elastic sealing seat covers a tube mouth of the liquid storage tube facing the suction nozzle, and is provided with a smoke exhaust hole connected with the suction nozzle; a second end of the elastic sealing seat is provided with a mounting slot; the atomizing core is located in the liquid storage tube and communicated with the smoke exhaust hole; the airflow sensor is located in the mounting slot;

the shell is provided with a connecting hole connected with the accommodating cavity; the suction nozzle comprises a sucking part and a covering part; a first end of the sucking part is located outside the shell, and a second end of the sucking part is extended into the accommodating cavity through the connecting hole; the covering part is located in the accommodating cavity and connected with the second end of the sucking part;

the covering part covers a surface of the elastic sealing seat opposite to the liquid storage tube; a sensing airway connected with the mounting slot is formed between the covering part and the elastic sealing seat, and the airflow sensor is connected with the sucking part through the sensing airway; and an upper surface of the covering part is abutted against the shell, and a lower surface of the covering part is abutted against the elastic sealing seat and seals an upper surface of the elastic sealing seat.

2. The electronic cigarette according to claim 1, wherein the electronic cigarette further comprises a condensate adsorption sheet, the elastic sealing seat is provided with an accommodating slot facing a surface of the sucking part, and the sensing airway comprises the accommodating slot; the airflow sensor is connected with the sucking part through the accommodating slot, and the condensate adsorption sheet is located in the accommodating slot.

3. The electronic cigarette according to claim 2, wherein a bottom wall of the accommodating slot is provided with a first gas slot, and the first gas slot is communicated with the smoke exhaust hole; and the condensate adsorption sheet is provided with a ventilation notch, a first end of the ventilation notch is communicated with the first gas slot, and a second end of the ventilation notch is communicated with the mounting slot.

4. The electronic cigarette according to claim 3, wherein an upper surface of the second end of the elastic sealing seat is provided with a second gas slot, the mounting slot is communicated with the ventilation notch through the second gas slot, and the height of the second gas slot is higher than the height of the first gas slot.

5. The electronic cigarette according to claim 1, wherein the mounting slot is located on a lower surface of the second end of the elastic sealing seat, a rabbet of the mounting slot is provided with a blocking protruding part, and the blocking protruding part is located on a side of the airflow sensor opposite to the covering part to prevent the airflow sensor from falling.

6. An electronic cigarette, comprising a shell, a suction nozzle, a liquid storage tube, an elastic sealing seat, an atomizing core and an airflow sensor, wherein:

the shell is provided with an accommodating cavity; the suction nozzle is connected with the shell, and the liquid storage tube is located in the accommodating cavity; a first end of the elastic sealing seat covers a tube mouth of the liquid storage tube facing the suction nozzle, and is provided with a smoke exhaust hole connected with the suction nozzle; a second end of the elastic sealing seat is provided with a mounting slot; the atomizing core is located in the liquid storage tube and communicated with the smoke exhaust hole;

the shell is provided with a connecting hole connected with the accommodating cavity; the suction nozzle comprises a sucking part and a covering part; a first end of the sucking part is located outside the shell, and a second end of the sucking part is extended into the accommodating cavity through the connecting hole; the covering part is located in the accommodating cavity and connected with the second end of the sucking part; the airflow sensor is located in the mounting slot and communicated with the sucking part; and the electronic cigarette further comprises a cover plate, a side wall of the shell is provided with a mounting mouth connected with the accommodating cavity, and the cover plate covers the mounting mouth and is connected with the covering part.

7. The electronic cigarette according to claim 6, wherein the covering part is provided with a first positioning part, the cover plate is provided with a second positioning part, and the first positioning part is connected with the second positioning part in an inserting manner; and the electronic cigarette further comprises a battery and a controller, the battery and the controller are both disposed in the accommodating cavity, and the controller is electrically connected with the airflow sensor and the battery.

8. The electronic cigarette according to claim 6, wherein a cavity wall of the accommodating cavity is provided with a fastening groove, the cover plate is provided with a fastening bulge, and the fastening bulge is connected with the fastening groove in a fastening manner.

9. The electronic cigarette according to claim 8, wherein the cover plate comprises a plate body, the plate body covers the mounting mouth, a first side edge of the plate body extends into the accommodating cavity to form a first connection bar, and a second side edge of the plate body extends into the accommodating cavity to form a second connection bar, the first connection bar and the second connection bar are disposed opposite to each other, and the first connection bar and the second connection bar are both provided with the fastening bulge.

10. The electronic cigarette according to claim 9, wherein the electronic cigarette further comprises a first protection sheet, and a first fixed slot is arranged on a side of the plate body opposite to the accommodating cavity, and the first protection sheet is accommodated in the first fixed slot.

11. The electronic cigarette according to claim 6, wherein the electronic cigarette further comprises a second protection sheet, and a second fixed slot is arranged on a side wall of the shell opposite to the mounting mouth, the second fixed slot is arranged opposite to the accommodating cavity, and the second protection sheet is accommodated in the second fixed slot.

12. An electronic cigarette, comprising a shell, a suction nozzle, a liquid storage tube, an elastic sealing seat, an atomizing core and an airflow sensor, wherein:

the shell is provided with an accommodating cavity; the suction nozzle is connected with the shell, and the liquid storage tube is located in the accommodating cavity; a first end of the elastic sealing seat covers a tube mouth of the liquid storage tube facing the suction nozzle, and is provided with a smoke exhaust hole connected with the suction nozzle; a second end of the elastic sealing seat is provided with a mounting slot; the atomizing core is located in the liquid storage tube and communicated with the smoke exhaust hole; the airflow sensor is located in the mounting slot;

the shell is provided with a connecting hole connected with the accommodating cavity; the suction nozzle comprises a sucking part and a covering part; a first end of the sucking part is located outside the shell, and a second end of the sucking part is extended into the accommodating cavity through the connecting hole; the covering part is located in the accommodating cavity and connected with the second end of the sucking part;

the covering part covers a surface of the elastic sealing seat opposite to the liquid storage tube; a sensing airway connected with the mounting slot is formed between the covering part and the elastic sealing seat, and the airflow sensor is connected with the sucking part through the sensing airway; and the elastic sealing seat is provided with a sealing slot on a surface facing the covering part, the sealing slot is arranged around the sensing airway, the covering part extends towards the elastic sealing seat to form a sealing wall part, and the sealing wall part is inserted in the sealing slot.

13. The electronic cigarette according to claim 12, wherein the second end of the elastic sealing seat is also provided with a first clamping notch and a second clamping notch, and the sealing slot is located between the first clamping notch and the second clamping notch; the covering part extends towards the elastic sealing seat to form a first clamping wall part and a second clamping wall part, and the first clamping wall part is inserted in the first clamping notch, and the second clamping wall part is inserted in the second clamping notch.

14. The electronic cigarette according to claim 12, wherein the first end of the elastic sealing seat is provided with a positioning slot, the covering part extends towards the elastic sealing seat to form a positioning wall part, and the positioning wall part is inserted in the positioning slot.

15. The electronic cigarette according to claim 14, wherein a first side of the first end of the elastic sealing seat is provided with a first clamping slot, a second side of the first end of the elastic sealing seat is provided with a second clamping slot, and the first side of the first end of the elastic sealing seat and the second side of the first end of the elastic sealing seat are set opposite to each other; and the covering part extends towards the elastic sealing seat to form a third clamping wall part and a fourth clamping wall part, and the third clamping wall part is inserted in the first clamping slot, and the fourth clamping wall part is inserted in the second clamping slot; and the positioning slot is located between the first clamping slot and the second clamping slot.

16. The electronic cigarette according to claim 12, wherein the electronic cigarette further comprises a porous liquid suction column for absorbing cigarette liquid; the porous liquid suction column is inserted into the liquid storage tube, and the porous liquid suction column is sleeved on the atomizing core; and the atomizing core comprises a first heating component, a second heating component and a connecting part, and the first heating component and the second heating component are both used for atomizing the cigarette liquid; a first end of the connecting part is detachably connected with the first heating component, a second end of the connecting part is detachably connected with the second heating component, and the second heating component is connected with the first heating component through the connecting part.

17. The electronic cigarette according to claim 16, wherein the first heating component comprises a first metal tube, a first heating element and a first porous liquid guide sheet, and a first end of the first metal tube is provided with a first liquid inlet notch; a portion of the first porous liquid guide sheet is mounted in the first metal tube, and a remaining portion of the first porous liquid guide sheet extends outwardly beyond the first metal tube through the first liquid inlet notch and is in contact with the porous liquid suction column; the first heating element is located in the first metal tube and is in contact with the first porous liquid guide sheet;

the second heating component comprises a second metal tube, a second heating element and a second porous liquid guide sheet, and the second metal tube is interconnected with the first metal tube; a first end of the second metal tube is provided with a second liquid inlet notch; a portion of the second porous liquid guide sheet is mounted in the second metal tube, and a remaining portion of the second porous liquid guide sheet extends outwardly beyond the second metal tube through the second liquid inlet notch and is in contact with the porous liquid suction column; the second heating element is located in the second metal tube and is in contact with the second porous liquid guide sheet; and the connecting part is an elastic connection tube; a first end of the elastic connection tube is detachably connected with a second end of the first metal tube, and a second end of the elastic connection tube is detachably connected with the first end of the second metal tube.

18. The electronic cigarette according to claim 17, further comprising a battery and a controller, wherein:

the battery and the controller are both disposed in the accommodating cavity, and the controller is electrically connected with the airflow sensor and the battery;

the first heating element is connected with a first wire, and the first heating element is electrically connected to the controller through the first wire;

the second heating element is connected with a second wire, and the second heating element is electrically connected to the controller through the second wire; and the second heating component further comprises a clamping seat, the clamping seat is inserted in the second metal tube, and the clamping seat and the second metal tube jointly clamp the second wire.

19. The electronic cigarette according to claim 12, wherein the sealing wall part is in an annular shape; a smoke outlet hole is provided in the sucking part; the smoke outlet hole is in communication with the smoke exhaust hole, and a smoke inlet of the smoke outlet hole is located in a space formed by the sealing wall part.

20. The electronic cigarette according to claim 4, further comprising a battery and a controller, wherein:

the battery and the controller are both disposed in the accommodating cavity, and the controller is electrically connected with the airflow sensor and the battery; and the accommodating slot and the second gas slot form the sensing airway.

* * * * *